US012203146B2

(12) United States Patent
Dynin et al.

(10) Patent No.: US 12,203,146 B2
(45) Date of Patent: Jan. 21, 2025

(54) CORED WIRE FOR OUT-OF-FURNACE TREATMENT OF METALLURGICAL MELTS

(71) Applicant: RESEARCH AND DEVELOPMENT CENTER NPP, LIMITED LIABILITY COMPANY, g. Chelyabinsk (RU)

(72) Inventors: Anton Iakovlevich Dynin, g. Chelyabinsk (RU); Igor Valerevich Bakin, g. Chelyabinsk (RU); Viktor Vladimirovich Novokreshchenov, g. Chelyabinsk (RU); Rinat Gilemovich Usmanov, g. Chelyabinsk (RU); Artem Andreevich Tokarev, g. Kamensk-Uralskiy (RU); Oleg Grigorevich Ryss, g. Chelyabinsk (RU)

(73) Assignee: RESEARCH AND DEVELOPMENT CENTER NPP, LIMITED LIABILITY COMPANY, Chelyabinsk (RU)

( * ) Notice: Subject to any disclaimer, the term of this patent is extended or adjusted under 35 U.S.C. 154(b) by 521 days.

(21) Appl. No.: 17/632,743

(22) PCT Filed: Jul. 6, 2020

(86) PCT No.: PCT/RU2020/050149
§ 371 (c)(1),
(2) Date: Feb. 3, 2022

(87) PCT Pub. No.: WO2021/025596
PCT Pub. Date: Feb. 11, 2021

(65) Prior Publication Data

US 2022/0282346 A1 Sep. 8, 2022

(30) Foreign Application Priority Data

Aug. 5, 2019 (RU) ..... 2019124735

(51) Int. Cl.

| | |
|---|---|
| ***C21C 7/00*** | (2006.01) |
| ***C21C 7/064*** | (2006.01) |
| ***C22C 1/10*** | (2023.01) |
| ***C23C 24/00*** | (2006.01) |

(52) U.S. Cl.
CPC ..... *C21C 7/0056* (2013.01); *C21C 7/0006* (2013.01); *C21C 7/0075* (2013.01); *C21C 7/0645* (2013.01); *C22C 1/1036* (2013.01); *C23C 24/00* (2013.01)

(58) Field of Classification Search
CPC ... C21C 7/0056; C21C 7/0006; C21C 7/0075; C21C 7/0645; C21C 7/06; C21C 1/00; C21C 7/00; C22C 1/1036; C23C 24/00
See application file for complete search history.

(56) References Cited

U.S. PATENT DOCUMENTS 5,352,271 A * 10/1994 Margaria ..... B23K 35/406 75/526
2010/0007067 A1 1/2010 Vermeulen

FOREIGN PATENT DOCUMENTS

| | | | |
|---|---|---|---|
| BE | 831644 | | 1/1976 |
| CN | 105463159 | | 4/2016 |
| CN | 106636552 | | 5/2017 |
| CN | 107674938 | | 2/2018 |
| CN | 109234492 | | 1/2019 |
| CN | 109355460 | | 2/2019 |
| EP | 0 281 485 | | 9/1988 |
| EP | 1 713 941 | | 10/2006 |
| RU | 2375462 | C2 * | 12/2009 |
| RU | 2 381 280 | | 2/2010 |
| RU | 2 447 176 | | 4/2012 |
| RU | 2 539 284 | | 1/2015 |
| RU | 2 651 514 | | 4/2018 |
| SU | 2 104 311 | | 2/1988 |
| WO | 2005/078142 | | 8/2005 |

OTHER PUBLICATIONS

RU-2375462-C2: Espacenet English machine translation (Year: 2009).*
International Search Report for PCT/RU2020/050149 dated Dec. 1, 2020, 8 pages.
Written Opinion of the ISA for PCT/RU2020/050149 dated Dec. 1, 2020, 8 pages.

* cited by examiner

*Primary Examiner* — Adil A. Siddiqui
(74) *Attorney, Agent, or Firm* — Nixon & Vanderhye PC

(57) ABSTRACT

A wire for out-of-furnace treatment of metallurgical melts comprises a metallic sheath which encloses a core comprising at least one element selected from the group consisting of Ca, Ba, Sr, Mg, Si and Al, wherein at least one layer of a composite coating is applied to an inner and/or outer surface of said sheath, which coating consists of a lacquer paint material and contains high-melting ultrafine particles selected from compounds of metal carbides and/or nitrides and/or carbonitrides and/or silicides and/or borides. The composite coating comprises a protector material, for which ferroalloys and/or flux agents are used. The metals contained in the high-melting compounds are titanium and/or tungsten and/or silicon and/or magnesium and/or niobium and/or vanadium. Said coating is applied evenly onto the surface of the sheath.

6 Claims, No Drawings

CORED WIRE FOR OUT-OF-FURNACE TREATMENT OF METALLURGICAL MELTS

This application is the U.S. national phase of International Application No. PCT/RU2020/050149 filed Jul. 6, 2020 which designated the U.S. and claims priority to RU patent application No. 2019124735 filed Aug. 5, 2019, the entire contents of each of which are hereby incorporated by reference.

The present invention pertains to the iron and steel industry and may be used in out-of-furnace treatment (secondary treatment) (metallurgy) of molten irons and steels, including in particular, for deoxidizing, desulfurizing and modifying iron carbon alloys using a cored wire with a filler material.

The prior art discloses the use of ultra-dispersed modifiers for out-of-furnace treatment (secondary treatment) of metallurgical melts.

The efficiency of ultra-dispersed modifiers largely depends on their morphological parameters, reactivity and the conditions under which melts undergo modification. The chief advantage of such modifiers is the large amount of particles per unit volume in the melt, which essentially determines the efficiency of structure refinement and, subsequently, leads to a substantial improvement in the mechanical strength and operational properties of cast products.

There is a modifier used for treating metallurgical melts known as RU2651514, IPC C21C1/00, C21C7/00, B82Y30/0, published on Apr. 19, 2018. It contains a multi-component filler encased in a hermetically sealed metal sheath (jacket). The filler is a mixture rendered uniform and coated with surface-active agents (surfactants); it contains at least two ultra- and/or fine-dispersed powder metals having particles up to 10 μm chosen from among the group consisting of iron, nickel, and aluminum, at least one compound of high melting-point metals, chosen from among metal carbides, metal borides, metal nitrides, and metal silicides with their particles ranging between 10 and 200 μm and, at least, one fine-dispersed powder chosen from among the group consisting of Cn fullerene, carbide clusters, silicon carbide, copper, calcium, barium, and REMs, whereupon compounds of high melting-point metals are incorporated into the powder metals. High melting-point metals are represented by molybdenum, vanadium, tungsten, zirconium, niobium, tantalum, chromium or hafnium.

The disadvantage of the prior art solution is that a filler is encased in a hermetically sealed metal sheath (jacket) in the form of steel ampoules or capsules. For their introduction into molten metal the sandwich process, the Inmold Process, the plunging method, and other well-known techniques are used. The use of a modifier enclosed in ampoules or capsules and the methods of its introduction into molten metal do not make it possible for the modifier to penetrate the full depth of the melt and spread uniformly therein, thus the modifying effect of the modifier is reduced.

There is a modifier used for treating liquid steel known as RU2447176, IPC C22C35/0, published on Aug. 20, 2011. It contains the nanodispersed powder of a high melting-point material and the powder of a protector. The protector is represented by the powder of one or more master alloys chosen from among the group consisting of ferrosilicon, ferromanganese, aluminum ferrosilicon, calcium silicon, barium silicon, calcium silicon barium.

The disadvantage of the prior art solution is that the modifier is represented by briquettes into which mixtures of powders uniform in terms of composition are pressed. The use of a modifier in the form of briquettes does not make it possible for the modifier to reach the required depth of penetration of the melt and spread uniformly therein, thus the modifying effect of the modifier is reduced.

The main reasons preventing ultra-dispersed modifiers from being used by foundries on a broad scale are that it is necessary to use additional pieces of equipment and that modifiers have to undergo preliminary preparation prior to being introduced into molten metal, inconsistent results brought about by the processes of coagulation of introduced particles, dissolution and distribution of modifiers throughout the entire volume of the melt.

It is received wisdom that the most technologically simple and efficient method of introducing modifiers into melts treated in out-of-furnace treatment facilities is the cored wire injection method. Use of ultra-dispersed materials (nanomaterials) as part of filler materials of cored wires makes it possible for them to reach a predetermined depth of molten metal thus eliminating the likelihood of their impact on molten metal prematurely (within its upper layers).

There is a nanostructured cored wire used for underwater welding known as RU2539284, IPC B23K35/368, B82B3/00 published on Jan. 20, 2015 20.01.2015. It consists of a metal sheath (jacket) encasing charge materials containing rutile concentrate, hematite, iron powder, ferromanganese, silicon dioxide, an alkali metal carbonate and an alkali metal complex fluoride. The surface of the sheath (jacket) has an inner composite coating in the form of a copper matrix in which the nano-sized particles of an activating flux are distributed. The flux contains an alkali metal fluoride.

Use of the composite coating in the form of a copper matrix makes production of a cored wire quite expensive. Besides, the electrolytic deposition of copper on the surface of the sheath (jacket) of a cored wire is an inefficient process as the substance does not coat the surface uniformly.

Use of this type of cored wire makes it possible to introduce nano-sized particles into a weld zone but the composition of this type of cored wire makes it impossible to use it for treating molten metal in an out-of-furnace treatment facility.

There is also a cored wire known as RU2381280, IPC C21C7/00 published on Feb. 10, 2010. It contains a powdered/granulated filler material, an inner metal sheath surrounding the said filler material, and, at least, one thermal barrier layer surrounding the said inner metal sheath. The thermal barrier layer is made of a material that pyrolyzes upon contact with a molten metal bath, and a soaking liquid loaded in said thermal barrier layer. The thermal barrier layer is Kraft paper, aluminized paper, or a multiple layer comprising at least one strip of Kraft paper and at least one layer of aluminized paper. The pyrolizing material is covered with a thin metallic sheet which is separate from the internal metallic liner. The outer metal sheath (jacket) is closed using a lock seam. The powder or particles of the filler material are compacted or embedded in a resin; the filler material contains at least one material chosen from among the group consisting of Ca, Bi, Nb, Mg, CaSi, C, Mn, Si, Cr, Ti, B, S, Se, Te, Pb, $CaC_2$, $Na_2CO_3$, $CaCO_3$, CaO, MgO and REMs.

The solution described in Patent RU2381280 has been selected as the closest prior art having the closest combination of features essential to the invention.

In the prior arrangement of the cored wire, the thermal barrier layer performs only one function: it prevents the filler material from entering the melt before the cored wire reaches a predetermined depth. The thermal barrier layer does not contain substances or materials that could produce a certain modifying effect on the melt.

The cored wire is distinctive for that a complex process is employed for it to be manufactured. A sheath having two metallic sheets separated by a layer of paper that has to be moistened (soaked with liquid). The two metallic sheets make the cored wire too stiff and complicate its coiling.

The idea of the present invention is to introduce an additional layer into a cored wire that performs not only a function as a thermal barrier layer but also contains ultra-dispersed substances that a certain modifying effect on the melt.

The technical problem that underlies the present invention and that is to be solved is to produce a cored wired with a filler material that has a combination of controllable properties making it possible to use such cored wire for modifying and microalloying metallurgical melts and ensure that it can be injected into the molten bath to reach a predetermined depth.

What makes it possible to solve the said technical problem is that a cored wire for modifying molten metal in an out-of-furnace treatment facility has a metal sheath (jacket) encasing a filler material containing at least one element chosen from among the group consisting of Ca, Ba, Sr, Mg, Si, Al. In addition, at least one coat of composite material is applied onto the inner and/or outer surface of the metal sheath (jacket). The composite material is, in fact, a paintwork material containing high melting-point ultra-dispersed particles selected from compounds of metal carbides and/or metal nitrides, and/or metal carbonitrides, and/or metal silicides, and/or metal borides.

In addition to the above, the paintwork material is polymer-based and/or alcohol-based.

The composite material contains a protective material represented by ferroalloys and/or fluxes.

The metals included in the high melting-point compounds of said cored wire coats are represented by titanium, and/or tungsten, and/or magnesium, and/or niobium, and/or vanadium.

Coats of the composite material are applied onto the surfaces of the metal sheath (jacket) uniformly.

Besides, the filler material may additionally contain at least one component selected from a group of $CaC_2$, $Na_2CO_3$, $CaCO_3$, $SrCO_3$, CaO, MgO.

Application of a composite material to the inner and/or outer surface of the metal sheath (jacket) makes it possible for the ultra-dispersed substances to be deposited over the entire length of the cored wire and, as a result, for them to penetrate all the way through the entire volume of the melt in a uniform manner. It also makes it possible to calculate the required amount of cored wire to be injected, to prevent the injected particles from coagulating, to increase the specific surface area of the modifier coming into contact with the melt, to create additional nucleation sites for solidification thus facilitating maximum assimilation of the modifier and refining the structure of the melt being modified.

Upon entering the melt, the composite material deposited on the inner and/or outer surface of the metal sheath (jacket) gets pyrolyzed absorbing the energy and chilling down the microparts of molten metal in which the injected cored wire is getting dissolved. In the course of this process, the ultra-dispersed particles get released. Further, it allows more time for the cored wire to get dissolved in the molten metal, thus making it possible for the filler material and the above ultra-dispersed particles to reach great depths, which enables maximum assimilation of the filler material and lower consumption of the cored wire used for modification purposes.

Use of ultra-dispersed particles in the form of metal carbides, and/or metal borides, and/or metal silicides, and/or metal nitrides, and/or metal carbonitrides, whose melting temperatures are higher than that of the molten metal being modified makes it possible for the particles to spread throughout the entire volume of the molten metal being modified. As a result, grain refinement is promoted and occurrence of grains of varying sizes is prevented, which results in obtaining the final product with consistently high isotropic physico-mechanical properties.

Use of the present invention makes it possible to increase the efficiency of the modifier encapsulated in the cored wire, improve the quality of the molten metal being modified, and broaden the scope of application of cored wires.

The ratio between the components of the filler material and the ultra-dispersed particles in the coating of the metal sheath (jacket) of a cored wire is calculated on a case-by-case basis depending on the composition of the molten metal being modified, the method of modification being used, and the preset properties of the final product.

According to the present invention, a cored wire for treating molten metal in an out-of-furnace treatment facility consists of a hermetically sealed metal sheath (jacket), which is predominantly a steel sheath (jacket). The sheath (jacket) is 0.2-0.6 mm thick, and in its predominant embodiment it should be 0.3-0.45 mm thick. The edges of the sheath (jacket) are closed using a lock seam.

At least one coat of composite material is applied onto the inner and/or outer surface of the metal sheath (jacket). The coating is a base matrix performing the function of a bonding substance and containing particles and a protective material. The protective material introduced into the base matrix makes it possible to eliminate the likelihood of the ultra-dispersed particles coagulating. It promotes their uniform distribution within the coating. The base matrix is a paintwork material. The paintwork material is polymer-based and/or alcohol-based. The composite material contains a protective material represented by ferroalloys and/or fluxes. The ultra-dispersed particles are represented by compounds of carbides, and/or borides, and/or silicides, and/or nitrides, and/or carbonitrides, whose melting temperature exceeds 1600° C.; The quantitative content of the ultra-dispersed particles in the coating is 0.01-0.5% of the weight of the molten metal being treated. The metals constituting a part of the above compounds may be titanium and/or tungsten, and/or silicon, and/or magnesium, and/or vanadium. The coating should predominantly not exceed 300 μm, and the size of the ultra-dispersed particles of the coating should range from 1 to 200 mμ, (nanometers). In specific embodiments of the cored wire the coating may exceed 300 μm.

The composite material applied onto the inner and/or outer surface of the metal sheath (jacket) of a cored wire is a thermal barrier layer containing modifying particles.

Inside the metal sheath (jacket) of a cored wire there is a multi-component filler material containing at least one element chosen from among the group consisting of Ca, Ba, Sr, Mg, Si, Al.

One of the specific embodiments of the filler material has the following components in terms of their percentages by weight: barium—0.001-35, calcium—0.001-35, strontium—0.001-35, magnesium—0.001-50, silicon—25-75, TRE—0.001-15, iron—the balance.

Besides, the filler material may additionally contain at least one component selected from a group of $CaC_2$, $Na_2CO_3$, $CaCO_3$, $SrCO_3$, CaO, MgO.

The filler material is represented by the above substances, for example, in powder or granular form with their particles not exceeding 3 mm in size.

The technical character of our invention is illustrated by examples of how the cored wire having the alleged composition was used for modifying liquid steel and iron.

EXAMPLE 1

In an electric arc furnace, steel 20GFL was melted. It had the following base components in terms of their percentages by weight:

Ca—0.16-0.25,
Si—0.20-0.50,
Mn—0.90-1.40.
V—0.06-0.12,
P up to 0.05,
S up to 0.05,
Fe being the balance;
the melt was tapped into two 10-t ladles.

In ladle #1, for the purpose of refining and modifying the molten metal, a cored wire was used 14 mm in diameter with its metal sheath (jacket) being 0.40 mm thick. It had the following components in terms of their percentages by weight: Si—43-51, Ca—18-22, Ba—10-15, Sr—10-15, its core ratio being 0.55. The inner surface of the metal sheath (jacket) had a paintwork-based coating applied to it. It had a modifying ultra-dispersed element, $TiC_{0.4}N_{0.6}$ (titanium carbonitride) with its particles being less than 5 mμ, in size making up 20% of the total and a slag-forming mixture, $CaO+CaF_2$ (calcium oxide+calcium fluoride) with its particles being less than 100 μm making up 80% of the total. The coat applied is 150-200 μm thick. The amount of the coat applied ensures that one meter of the cored wire contain at least 10 g of titanium carbonitride. A total of 5 kg of cored wire was consumed per one ton of molten metal.

In ladle #2, for the purpose of modifying the molten metal, a cored wire containing silicon calcium (SiCa40) was used.

As the properties of the melt modified with the cored wire having the alleged composition and those of the melt modified with the cored wire containing silicon calcium (SiCa40) were compared, the following results were obtained.

Use of the cored wire having the alleged composition made it possible to reduce the size of the grain by 24%, increase the microhardness by 7.4% and improve KCV impact toughness at −60° C. of the modified melt by 49%. It also became possible to reduce the content of non-metallic inclusions.

Use of the cored wire having the above composition made it possible to improve the strength, ductility and impact toughness of the modified melt.

EXAMPLE 2

In an electric arc furnace, steel 20GFL was melted. It had the following base components in terms of their percentages by weight:

Ca 0.16-0.25,
Si 0.20-0.50.
Mn 0.90-1.40.
V 0.06-0.12,
P up to 0.05,
S up to 0.05,
Fe being the balance,
the melt was tapped into two 10-t ladles.

In ladle #1, for the purpose of refining and modifying the molten metal, a cored wire was used 14 mm in diameter with its metal sheath (jacket) being 0.40 mm thick. It had the following components in terms of their percentages by weight: Si—43-51, Ca—18-22, Ba—10-15, Sr—10-15, its core ratio being 0.55. The inner surface of the metal sheath (jacket) had a paintwork-based coating applied to it. It had a modifying ultra-dispersed element, 70% TiC+30% VC (70% titanium carbide+30% of vanadium carbide) with its particles being less than 5 mμ in size making up 20% of the total, and ground ferrotitanium (FeTi70) with its particles being less than 100 μm in size making up 30% of the total, and a slag-forming mixture, $CaO+CaF_2$ (calcium oxide+calcium fluoride) with its particles being less than 100 μm making up 50% of the total. The coat applied was 150-200 μm thick. The amount of the coat applied ensured that one meter of the cored wire contain at least 15 g of titanium carbide and vanadium carbide. A total of 5 kg of cored wire was consumed per one ton of molten metal.

In ladle #2, for the purpose of modifying the molten metal, a cored wire containing silicon calcium (SiCa40) was used.

As the properties of the melt modified with the cored wire having the alleged composition and those of the melt modified with the cored wire containing silicon calcium (SiCa40) were compared, the following results were obtained.

Use of the cored wire having the alleged composition made it possible to reduce the size of the grain by 29%, increase the microhardness by 8.1% and improve KCV impact toughness at −60° C. of the modified melt by 52%. It also became possible to reduce the content of non-metallic inclusions.

EXAMPLE 3

In an induction furnace, grey iron (SCh25) was melted. It had the following base components in terms of their percentages by weight:

Ca 3.20-3.40,
Si 1.40-2.20,
Mn 0.70-1.00,
P up to 0.20,
S up to 0.15,
Fe being the balance,
the melt was tapped into two 5-t ladles.

In ladle #1, for the purpose of refining and modifying the molten metal, a cored wire was used 14 mm in diameter with its metal sheath (jacket) being 0.40 mm thick. It had the following components in terms of their percentages by weight: Si—65-75, Ca—0.80-1.5, Ba—3.5-5.00, Al—1.00-2.00, its core ratio being 0.5. The inner surface of the metal sheath (jacket) had an alcohol-based coating applied to it. It had the following modifying elements: $SiC+Si_3N_4$ (silicon carbide+silicon nitride) with its particles being less than 5 mu in size making up 20% of the total and ground, finely dispersed ferrosilicon with magnesium and barium with its particles being less than 100 μm making up 80% of the total. The coat applied is 150-200 μm thick. The amount of the coat applied ensured that one meter of the cored wire contain at least 15 g of a mixture of carbides and nitrides. A total of 5 kg of cored wire was consumed per one ton of molten metal.

In ladle #2, for the purpose of modifying the molten metal, a cored wire containing ferrosilicon (FeSi75) was used.

As the properties of the melt modified with the cored wire having the alleged composition and those of the melt modified with the cored wire containing ferrosilicon (FeSi75) were compared, the following results were obtained.

Use of the cored wire having the alleged composition made it possible to increase the yield strength by 10.3% and the tensile strength by 12.1%. It also became possible to improve the wear resistance of the resultant castings.

The cored wire with the alleged composition may be manufactured as follows. A metal strip between 0.2 and 0.6 mm thick is roll formed into a cylinder-shaped sheath, or jacket, having a trough like configuration. A preliminarily prepared powdered filler material is fed into the sheath (jacket) from a hopper bin and distributed uniformly along its length. A composite coating is applied to the inner and/or outer surface of the sheath (jacket) before or after the roll forming process and before the sheath (jacket) is filled with the filler material. The coating is applied to the inner and/or outer surface of the sheath (jacket) by spraying or by sprinkling or by means of rollers. After the sheath (jacket) is filled with the filler material, the sheath (jacket) is further roll formed to close around the filler material and form a continuous lock seam. The cored wire thus produced is packaged in coils.

Cored wires are injected into molten metal using injection machines at speeds ranging from 35 to 300 m/min. Consumption of cored wire is calculated based on the rate of consumption of filler material equaling 1.5-7.0 kg per ton of molten metal.

The present cored wire for out-of-furnace treatment (secondary treatment) metallurgical melts is distinguished by the great reliability in how it functions and ease of manufacture; it can be manufactured using familiar equipment, materials and techniques.

The terms and word combinations used in this description such as "contains", "containing", "in the predominant embodiment", "predominantly", "in particular", "may be" should not be interpreted as excluding the presence of other materials, parts, structural elements, actions.

The invention claimed is:

1. A cored wire adapted for out-of-furnace treatment of metallurgical melts having a steel sheath that encases a filler material containing at least one element selected from the group consisting of Ca, Ba, Sr, Mg, Si, and Al, wherein at least one layer of composite coating is applied onto the inner and/or outer surface of the sheath, wherein the composite coating is a paint containing ultrafine particles selected from the group consisting of compounds of metal carbides, metal nitrides, metal carbonitrides, metal silicides, metal borides, and combinations thereof.

2. The cored wire according to claim 1, wherein the paint is polymer-based and/or alcohol-based.

3. The cored wire according to claim 1, wherein the composite coating contains a protective material selected from the group consisting of: ferroalloys, fluxes, and combinations thereof.

4. The cored wire according to claim 1, wherein the metals contained in the compounds are selected from the group consisting of: titanium, tungsten, silicon, magnesium, niobium, vanadium, and combinations thereof.

5. The cored wire according to claim 1, wherein layers of the composite coating are applied onto the surfaces of the sheath uniformly.

6. The cored wire according to claim 1, wherein the filler material additionally contains at least one component selected from the group consisting of: $CaC_2$, $Na_2CO_3$, $CaCO_3$, $SrCO_3$, CaO, and MgO.

* * * * *